United States Patent [19]

Tokura et al.

[11] Patent Number: 4,584,553

[45] Date of Patent: Apr. 22, 1986

[54] COATED LAYER TYPE RESISTOR DEVICE

[75] Inventors: Norihito Tokura, Nukata; Hisasi Kawai, Toyohashi, both of Japan

[73] Assignee: Nippon Soken, Inc., Nishio, Japan

[21] Appl. No.: 617,478

[22] Filed: Jun. 5, 1984

[30] Foreign Application Priority Data

Jun. 7, 1983 [JP] Japan ..... 58-102112

[51] Int. Cl.[4] ..... H01C 1/01

[52] U.S. Cl. ..... 338/320; 219/543; 338/295; 338/309; 338/314; 338/328

[58] Field of Search ..... 219/203, 522, 541, 543; 338/195, 295, 211, 212, 308, 309, 314, 320, 323, 327, 328, 330; 29/619, 620

[56] References Cited

U.S. PATENT DOCUMENTS

| | | | |
|---|---|---|---|
| 2,748,234 | 5/1956 | Clarke et al. | 338/309 X |
| 3,668,600 | 6/1972 | Schuberth et al. | 338/320 |
| 3,669,733 | 6/1972 | Allington | 338/309 X |
| 3,692,987 | 9/1972 | Bos | 338/320 X |
| 3,771,095 | 11/1973 | Calhoun et al. | 338/320 |
| 3,916,366 | 10/1975 | Jefferson | 338/328 X |
| 3,983,528 | 9/1976 | King | 338/195 |
| 4,199,745 | 4/1980 | Barry | 338/320 |
| 4,309,687 | 1/1982 | Utner et al. | 338/309 X |
| 4,319,217 | 3/1982 | Ambros et al. | 338/308 |
| 4,371,861 | 2/1983 | Abdelrahman et al. | 338/308 X |

*Primary Examiner*—Volodymyr Y. Mayewsky
*Attorney, Agent, or Firm*—Cushman, Darby & Cushman

[57] ABSTRACT

A coated layer type resistor device having a first resistor element and a second resistor element. The ratio between the resistances of the first and second resistor elements is selected to be greater than a predetermined ratio. The first resistor element is formed on an insulator substrate and consists of a resistor layer and end conductor electrodes at the ends of the resistor layer, while the second resistor element is formed on the substrate and consists of a resistor layer, end conductor electrodes, and a plurality of intermediate conductors. The distance between adjacent ones of the intermediate conductors and the distance between one of the end conductor electrodes and the adjacent intermediate conductor in the second resistor element is equal to the distance between the end conductor electrodes in the first resistor element, so that the temperature coefficient property of the resistance is equal in both the first and second resistor elements.

3 Claims, 4 Drawing Figures

COATED LAYER TYPE RESISTOR DEVICE

BACKGROUND OF THE INVENTION

1. Field of the Invention

The present invention relates to a coated layer type resistor device. The resistor device according to the present invention is used for, for example, a bridge circuit in electronic apparatuses.

2. Description of the Prior Art

In a prior art process for manufacturing a coated layer type resistor device consisting of a first resistor element and a second resistor element, conductor electrodes for the first resistor element and conductor electrodes for the second resistor element are formed on an insulator substrate made of alumina ceramics by a screen printing process. A resistor layer for the first resistor element is then formed on the substrate between the conductor electrodes for the first resistor element and portions of the conductor electrodes for the first resistor element by a screen printing process, and a resistor layer for the second resistor element is formed on the substrate between the conductor electrodes for the second resistor element and portions of the conductor electrodes for the second resistor element by a screen printing process. Then a heat treatment is carried out to establish electrical connection between the resistor layer for the first resistor element and the conductor electrodes for the first resistor element, and between the resistor layer for the second resistor element and the conductor electrodes for the second resistor element.

During this heat treatment process, some of the constituents of the end conductor electrodes, such as silver or platinum, may be diffused into the resistor layers to form boundary portions in the resistor layers adjacent to the end conductor electrodes. Thus, in each of the boundary portions in the resistor layers, the electrical property of the resistor layer has been changed. It is known that the temperature coefficient of the resistance (TCR) of the first resistor element 1 is greatly affected by the TCR of such boundary portions of the resistor layers.

Under this condition, when the ratio $R_2/R_1$ of the resistances of the second and the first resistor elements is selected to be greater than a predetermined ratio, the relationship between the length $l_2$ of the resistor layer between the conductor electrodes for the second resistor element and the length $l_1$ of the resistor layer between the conductor electrodes for the first resistor element becomes $l_1 < l_2$.

Under such a relationship, wherein $l_1 < l_2$ between the first and second resistor elements, the influence of the boundary portions in the resistor layer for the first resistor element on the TCR of the first resistor element is different from the influence of the boundary portions in the resistor layer for the second resistor element on the TCR of the second resistor element.

Thus, the TCR of the first resistor element becomes different from the TCR of the second resistor element, and the ratio $R_2/R_1$ is changed as the circumferential temperature is changed. Accordingly, it is difficult to realize the ratio $R_2/R_1$ with a high precision. This constitutes a problem in the prior art.

Even if the lengths of the resistor layers of the first and the second resistor elements are made equal, in order to equalize the TCR's of the first and the second resistor elements, the width $d_1$ of the resistor layer for the first resistor element must be greater than the width $d_2$ of the resistor layer for the second resistor element, for maintaining the ratio $R_2/R_1$ at a value greater than a predetermined ratio. This requirement makes it necessary to increase the size of the resistor layer for the first resistor element, and such an increase in the size of the resistor layer causes another problem in the structure and the manufacturing process of a resistor device.

SUMMARY OF THE INVENTION

The object of the present invention is to provide an improved coated layer type resistor device in which the temperature coefficient property of the resistance of the resistor device is excellent and the ratio between the resistor elements in a resistor device consisting of a pair of resistor elements is increased.

According to the present invention, there is provided a coated layer type resistor device comprising: an insulator substrate; a first resistor element formed on the insulator substrate and consisting of a resistor layer and end conductor electrodes at the ends of the resistor layer; and a second resistor element formed on the insulator substrate connected in a predetermined relationship with the first resistor element and consisting of a resistor layer, end conductor electrodes at the ends of the resistor layer, and a plurality of intermediate conductors. The ratio between the resistances of the first and second resistor elements is selected to be greater than a predetermined ratio; and the distance between adjacent intermediate conductors and the distance between one of the end conductor electrodes and the adjacent intermediate conductor in the second resistor element is equal to the distance between the end conductor electrodes in the first resistor element.

DESCRIPTION OF THE PREFERRED EMBODIMENTS

Figure 1A:
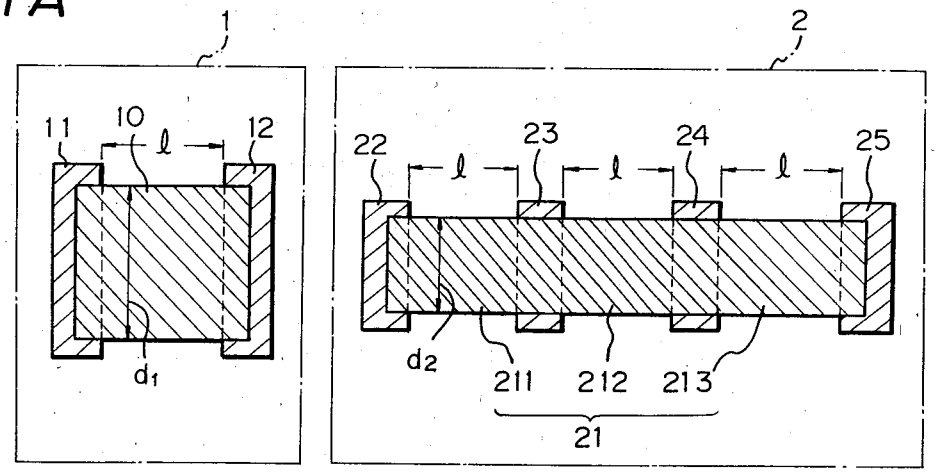
FIGS. 1A and 1B show a coated type resistor device as an embodiment of the present invention.
Figure 1B:
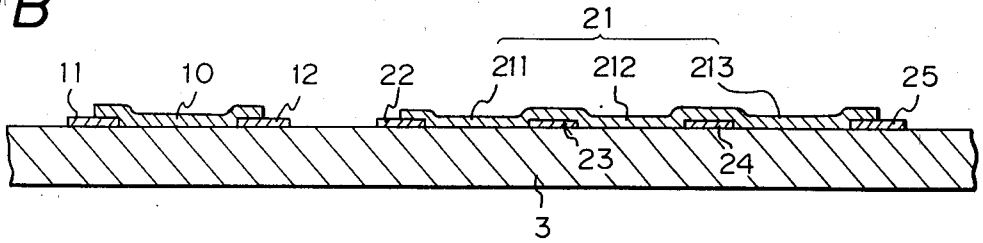

A coated layer type resistor device as an embodiment of the present invention is illustrated in FIG. 1A. A cross- sectional view of the device of FIG. 1A is shown in FIG. 1B. The device shown in FIGS. 1A and 1B includes an insulator substrate 3 made of, for example, alumina ceramic, resistor layers 10 and 21 (consisting of portions 211, 212, and 213), end conductor electrodes 11, 12, 22, and 25, and intermediate conductors 23 and 24. The resistor layer 10 and end conductor electrodes 11 and 12 constitute a first resistor element 1, and the resistor layer 21, the end conductor layers 22 and 25, and the intermediate conductors 23 and 24 constitute a second resistor element 2.

The end conductors 11, 12, 22, and 25 and the intermediate conductors 23 and 24 are formed of a silver, platinum, or the like paste mixed with a glass binder. The resistor layer 21 is formed of a ruthenium dioxide $RuO_2$ paste mixed with a glass binder.

In the manufacturing process for the resistor device shown in FIGS. 1A and 1B, the end conductors 11, 12, 22, and 25, and the intermediate conductors 23 and 24 are formed simultaneously by a screen printing process using the above- described paste. After the formation of the end conductors 11, 12, 22, and 25 and the intermediate conductors 23 and 24, the resistor layers 10 and 21 are formed by a screen printing process in such a manner that the resistor layer 10 overlaps portions of the end conductor electrodes 11 and 12, and the resistor layer 21 overlaps portions of the end conductor electrodes 22 and 25 and the intermediate conductors 23 and 24.

The length of the portion of the resistor layer 10 between the end conductor electrodes 11 and 12, the length of the portion 211 of the resistor layer 21 between the end conductor layer 22 and the intermediate conductor 23, the length of the portion 212 of the resistor layer 21 between the intermediate conductors 23 and 24, and the length of the portion 213 of the resistor layer between the intermediate conductor 24 and the end conductor electrode 25 are all represented as l.

The width of the resistor layer 10 of the first resistor element 1 is $d_1$, while the width of the resistor layer 21 of the second resistor element 2 is $d_2$.

In the resistor device shown in FIGS. 1A and 1B, the TCR of the first resistor element 1 is equal to the TCR of the second resistor element 2. The reason for the equality of the TCR will be explained below with reference to FIG. 2.

In the process for manufacturing the device shown in FIGS. 1A and 1B, a heat treatment is carried out after the resistor layers 10 and 21 are formed to overlap portions of the end conductor electrodes 11, 12, 22, and 25 and the intermediate conductors 23 and 24 to establish an electric connection through the overlap areas between the resistor layers and the end conductor electrode and between the resistor layers and the intermediate conductors.

During this heat treatment, some of the constituents of the end conductor electrodes and the intermediate conductors, such as silver or platinum, are diffused into the resistor layer to form boundary portions 10A, 10B, 211A, 211B, 212A, 212B, 213A, and 213B in the resistor layers. Thus, in each of the boundary portions, the electrical property of the resistor layer has been changed. It is known that the TCR of a resistor layer is greatly affected by the TCR of such boundary portions of the resistor layer.

Figure 2:
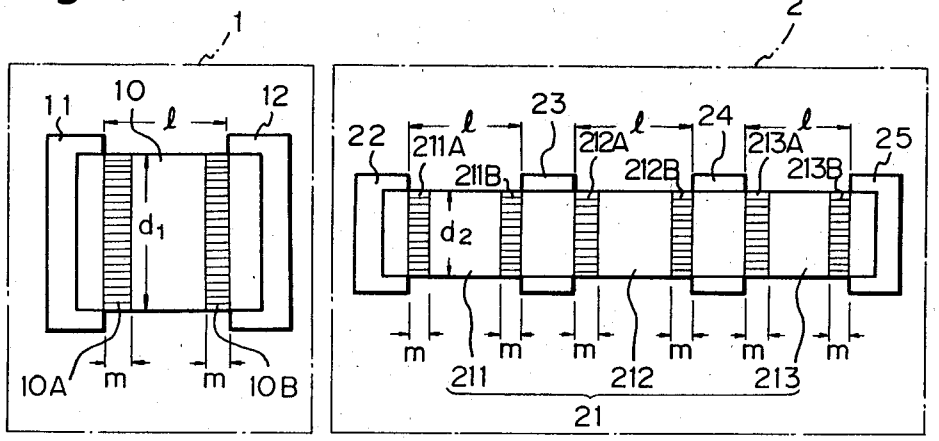
FIG. 2 illustrates the characteristic of the temperature coefficient of the resistance of the resistor device shown in FIGS. 1A and 1B.

However, as illustrated in FIG. 2, each of the lengths of the boundary portions 10A, 10B, 211A, 211B, 212A, 212B, 213A, and 213B of the resistor device shown in FIGS. 1A and 1B is the same length m. The effect of the boundary portions in the device shown in FIGS. 1A and 1B is expressed as 2m/l for the resistor element 1, and as 6m/3l (=2m/l) for the resistor element 2. Thus, the influence of the boundary portions on the TCR of the resistor layer is the same in both the resistor element 1 and the resistor element 2.

It is assumed that the resistances at a temperature of 0° C. of the resistor elements 1 and 2 are $R_1(0)$ and $R_2(0)$, respectively. However, because the TCR is the same for both the resistor element 1 and the resistor element 2, the resistances at a temperature t° C. of the resistor elements 1 and 2 are as follows.

$$R_1(t)=R_1(0)\times(1+\mathrm{TCR}\times t)$$

$$R_2(t)=R_2(0)\times(1+\mathrm{TCR}\times t)$$

Therefore, the ratio $R_2(t)/R_1(t)$ of the resistances of the resistor elements 2 and 1 is equal to $R_2(0)/R_1(0)$, which is constant regardless of the temperature.

Figure 3:
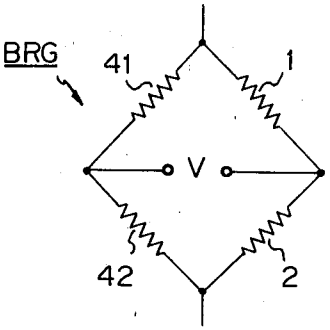
FIG. 3 shows a bridge circuit for which the resistor device shown in FIGS. 1A and 1B is used.

When the resistor device shown in FIGS. 1A and 1B is used for the branch resistors 1 and 2 of a bridge circuit BRG shown in FIG. 3 used for setting the gain of an amplifier device, the property of the branch resistors 1 and 2 is extremely suitable, because the resistance ratio $R_1(t)/R_2(t)$ is precisely constant.

Although in the above-described embodiment the number of portions of the resistor layer in the second resistor element is three, it is possible to select the number of portions of the resistor layer in the second resistor element to be other than three, provided that the length of each of the portions of the second resistor element is equal to the length of the resistor layer of the first resistor element.

We claim:

1. A coated layer type resistor device comprising:

an insulator substrate;

a first resistor element formed on said insulator substrate and consisting of a resistor layer and end conductor electrodes at the ends of said resistor layer; and a second resistor element formed on said insulator substrate connected in a predetermined relationship with said first resistor element and consisting of a resistor layer, end conductor electrodes at the ends of said resistor layer, and a plurality of intermediate conductors;

the ratio between the resistances of said first and second resistor elements being selected to be greater than a predetermined ratio; the distance between adjacent ones of said intermediate conductors and the distance between one of said end conductor electrodes and the adjacent intermediate conductor in said second resistor element being equal to the distance between end conductor electrodes in said first resistor element.

2. A coated layer type resistor device according to claim 1, wherein:

said end conductor electrodes and said intermediate conductors are formed by printing on said insulator substrate;

on said insulator substrate having said formed end conductor electrodes and intermediate conductors, a resistor layer is formed by printing; and said formed resistor layer is in contact with said formed end conductor electrodes and intermediate conductors.

3. A coated layer type resistor device according to claim 1, wherein a bridge circuit is constituted by said first and second resistor elements.

* * * * *